US010340632B1

(12) United States Patent
Rangi et al.

(10) Patent No.: US 10,340,632 B1
(45) Date of Patent: Jul. 2, 2019

(54) ELECTRICAL CONNECTOR ASSEMBLY WITH STAGED RELEASE

(71) Applicant: Lear Corporation, Southfield, MI (US)

(72) Inventors: Bhupinder Rangi, Novi, MI (US); David Menzies, Linden, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 16/001,528

(22) Filed: Jun. 6, 2018

(51) Int. Cl.
*H01R 13/62* (2006.01)
*H01R 13/627* (2006.01)
*H01R 13/631* (2006.01)
*H01R 13/641* (2006.01)

(52) U.S. Cl.
CPC ..... *H01R 13/6275* (2013.01); *H01R 13/631* (2013.01); *H01R 13/641* (2013.01)

(58) Field of Classification Search
CPC ..... H01R 13/641
See application file for complete search history.

(56) References Cited

U.S. PATENT DOCUMENTS 5,203,719 A 4/1993 Kozono
5,507,666 A 4/1996 Yamanashi
5,839,915 A 11/1998 Ford et al.
6,406,319 B2 6/2002 Pederson et al.
6,857,892 B2 2/2005 McLauchlan et al.
8,167,647 B1 * 5/2012 Lee ..... H01R 13/6277 439/352

* cited by examiner

*Primary Examiner* — Ross N Gushi

(74) *Attorney, Agent, or Firm* — MacMillan, Sobanski & Todd, LLC

(57) ABSTRACT

An electrical connector assembly includes a first connector including a first electrical terminal and a second connector including a second electrical terminal. The first connector and the second connector are movable from a mated position toward an unmated position. The second connector includes a first block, a second block, and a third block. The electrical connector assembly also includes a connector position assurance that is movable between an assurance position and a pre-lock position. The connector position assurance includes a stop tab. The first block is positioned to engage the stop tab when the connector position assurance is located in the pre-lock position. The second block is positioned to engage the stop tab when the first connector is located a first distance from the second connector. The third block is positioned to engage the stop tab when the first connector is located a second distance from the second connector.

20 Claims, 13 Drawing Sheets

ELECTRICAL CONNECTOR ASSEMBLY WITH STAGED RELEASE

BACKGROUND OF THE INVENTION

This invention relates to an electrical connector assembly. More specifically, this invention relates to an electrical connector assembly including features that increase the amount of time required to disconnect the electrical connector assembly.

A typical electrical connector assembly includes a first connector and a second connector that can be selectively mated with each other. Each of the first and second connectors supports one or more electrical terminals therein. When the first connector is mated with the second connector, the electrical terminals supported within the first connector are mated with the appropriate electrical terminals supported within the second connector.

An electrical connector assembly may additionally include a connector position assurance that confirms that the first and second connectors (and the electrical terminals supported therein) are properly mated when assembled. A typical connector position assurance is a lock-like device that is attached to the first connector and is initially located in a pre-lock position. When the first connector is properly mated with the second connector, the connector position assurance may then be moved from the pre-lock position to an assurance position. If the first connector is not properly mated with the second connector, then the connector position assurance will not be able to move to the assurance position. This allows an operator assembling the electrical connector assembly to confirm that the first and second connectors (and the electrical terminals supported therein) are properly mated when assembled.

Electrical connections to sources of electrical energy, such as a drive battery of a battery electric vehicle, are typically high voltage connections in the automotive industry and, thus, use high voltage connectors supporting high voltage electrical terminals. In many instances, an electrical circuit employed in such a high voltage connection commonly includes a safety structure known as a high voltage interlock loop. A typical high voltage interlock loop is a separate (usually low voltage) circuit that is operationally connected with the high voltage circuit. The high voltage interlock loop is arranged such that the low voltage circuit must be first opened before the high voltage circuit may subsequently be opened. When a controller detects that the low voltage circuit has been opened, it disables the high voltage circuit, thus preventing electrical current from continuing to flow. Additionally, the controller will not restore current to the high voltage circuit until after the low voltage circuit is closed. Thus, the high voltage interlock loop operates to turn off the high voltage circuit before the high voltage terminals are separated and will not subsequently turn on the high voltage circuit until after the high voltage terminals are mated. It would be advantageous to have an alternative electrical connector assembly that delays the operator in separating the first connector from the second connector.

SUMMARY OF THE INVENTION

The invention relates to an electrical connector assembly that includes a first connector including a first electrical terminal and a second connector including a second electrical terminal. The first connector and the second connector are movable from a mated position toward an unmated position. The second connector includes a first block, a second block, and a third block. The electrical connector assembly also includes a connector position assurance that is movable between an assurance position and a pre-lock position. The connector position assurance includes a stop tab. The first block is positioned to engage the stop tab when the connector position assurance is located in the pre-lock position. The second block is positioned to engage the stop tab when the first connector is located a first distance from the second connector. The third block is positioned to engage the stop tab when the first connector is located a second distance from the second connector.

Various aspects of this invention will become apparent to those skilled in the art from the following detailed description of the preferred embodiment, when read in light of the accompanying drawings.

BRIEF DESCRIPTION OF THE DRAWINGS

FIGS. 11A-17A are cross sectional views similar to FIG. 10A showing a sequence of movements as the first connector is unmated from the second connector.

FIGS. 11B-17B are cross sectional views similar to FIG. 10B showing a sequence of positions of the lock that correspond to the sequence of movements shown in FIGS. 11A-17A, respectively.

DETAILED DESCRIPTION OF THE PREFERRED EMBODIMENT

Figure 1:
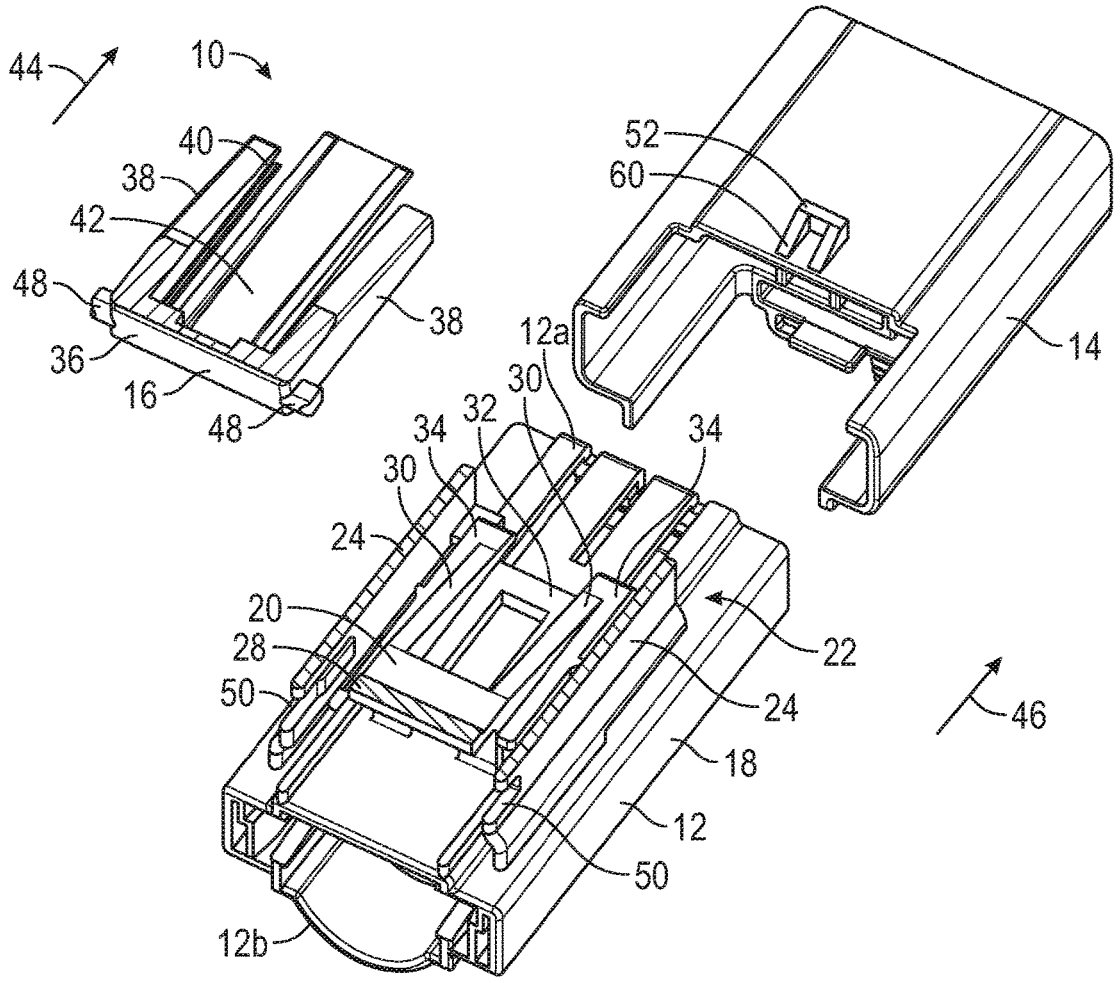
FIG. 1 (Prior Art)
FIG. 1 is an exploded perspective view of a prior art electrical connector assembly including a first prior art connector, a second prior art connector, and a prior art connector position assurance.

Referring now to the drawings, there is illustrated in FIG. 1 an exploded perspective view of a prior art electrical connector assembly, indicated generally at 10. The prior art electrical connector assembly 10 includes a first prior art connector 12, a second prior art connector 14, and a prior art connector position assurance (CPA) 16. The first prior art connector 12 extends from a mate end 12*a* to an insertion end 12*b*. The first prior art connector 12 includes a first connector body 18 having an integrally molded latch 20. A latch cover, indicated generally at 22, provides protection for the latch 20 and includes two side walls 24 that extend from the first connector body 18 and an upper cover 26 (see FIGS. 3-6) that extends between the side walls 24. The upper cover 26 is not shown in FIGS. 1 and 2 so that the details of the latch 20 are visible.

The latch 20 includes a latch base 28 that is attached to the first connector body 18 by two parallel, resilient latch arms 30 that allow limited movement of the latch base 28 relative to the first connector body 18, as will be described below. The two latch arms 30 extend from the latch base 28, and a latch hook 32 extends between the latch arms 30. Each latch arm 30 includes a guide projection 34 on an outer edge thereof.

The prior art CPA 16 includes a CPA base 36 and two parallel CPA arms 38 that extend from the CPA base 36. Each CPA arm 38 includes a guide channel 40 (one is visible in FIG. 1) on an inner edge thereof. The prior art CPA 16 includes a CPA tongue 42 that extends from the CPA base 36 generally parallel to the CPA arms 38 and that is located between the CPA arms 38. The CPA tongue 42 is resilient and is able to bend relative to the CPA base 36, as will be described below.

To attach the prior art CPA 16 to the first prior art connector 12, each of the guide projections 34 on the latch 20 is positioned in one of the guide channels 40 on the prior art CPA 16. The CPA base 36 is positioned so that the CPA tongue 42 is located between the latch base 28 and the first connector body 18 and extends between the resilient arms 30 of the latch 20. Additionally, the latch hook 32 is located between the CPA tongue 42 and the first connector body 18. When the prior art CPA 16 is installed on the first prior art connector 12, it is attached to the latch 20 and is able to be moved in an assurance direction 44 relative to the latch 20, as will be described below.

Figure 2:
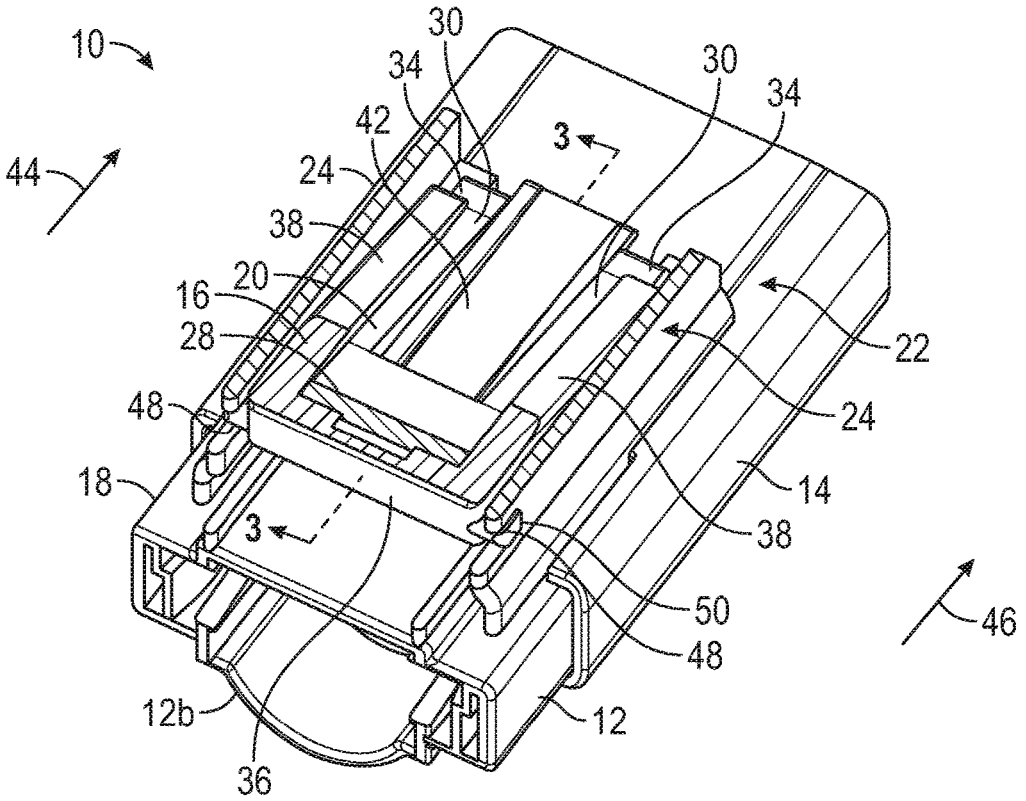
FIG. 2 (Prior Art)
FIG. 2 is a perspective view of the prior art electrical connector assembly illustrated in FIG. 1 shown assembled.

FIG. 2 is a perspective view similar to FIG. 1, showing the prior art electrical connector assembly 10 in a mated position. As shown, the prior art CPA 16 is attached to the first prior art connector 12, and the first prior art connector 12 is mated with the second prior art connector 14. The first prior art connector 12 is mated with the second prior art connector 14 by moving the first prior art connector 12 in a mate direction 46 into engagement with the second prior art connector 14. The prior art electrical connector assembly 10 is shown with the first prior art connector 12 in a fully mated position with the second prior art connector 14 such that electrical terminals (not shown) supported within the first prior art connector 12 are mated with corresponding electrical terminals (not shown) supported within the second prior art connector 14. Additionally, the prior art CPA 16 is shown in an assurance position relative to the first prior art connector 12. When the prior art CPA 16 is in the assurance position, lock tabs 48 on the prior art CPA 16 are located in lock notches 50 on the first prior art connector 12.

Figure 3:
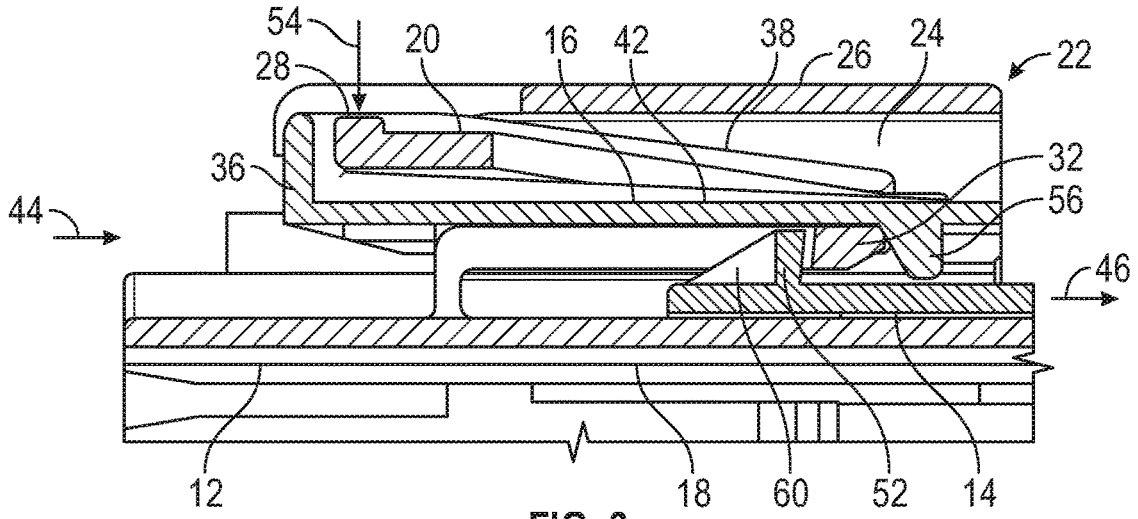
FIG. 3 (Prior Art)
FIG. 3 is a cross sectional view taken along the line 3-3 of FIG. 2 showing the connector position assurance in an assurance position.

Referring to FIG. 3, a cross sectional view of a portion of the prior art electrical connector assembly 10, taken along line 3-3 of FIG. 2, is shown. The cross sectional view shown in FIG. 3 is taken through the center of the CPA tongue 42. The upper cover 26 is shown in FIG. 3 and, as shown, the upper cover 26 leaves the latch base 28 exposed so that an operator can press on the latch base 28. The latch hook 32 on the latch 20 is engaged with a catch 52 on the second prior art connector 14 and prevents the first prior art connector 12 from being moved opposite the mate direction 46 relative to the second prior art connector 14. In order to release the latch 20 from the catch 52, the operator may apply a release force 54 to the latch base 28. However, with the prior art CPA 16 in the assurance position, the latch 20 is prevented from moving relative to the catch 52.

As previously described and shown in FIG. 2, the guide channels 40 on the CPA arms 38 are engaged with the guide projections 34 on the latch arms 30. As a result, when the latch 20 is moved relative to the first connector body 18 by bending the resilient arms, the prior art CPA 16 will also move relative to the first connector body 18 along with the latch 20. However, when the prior art CPA 16 is in the assurance position, the lock tabs 48 on the prior art CPA 16 are located in lock notches 50 on the first prior art connector 12, which prevents the prior art CPA 16 and the latch 20 from moving relative to the first connector body 18. As a result, the latch 20 will not release the catch 52, and the first prior art connector 12 cannot be moved opposite the mate direction 46 relative to the second prior art connector 14.

Figure 4:
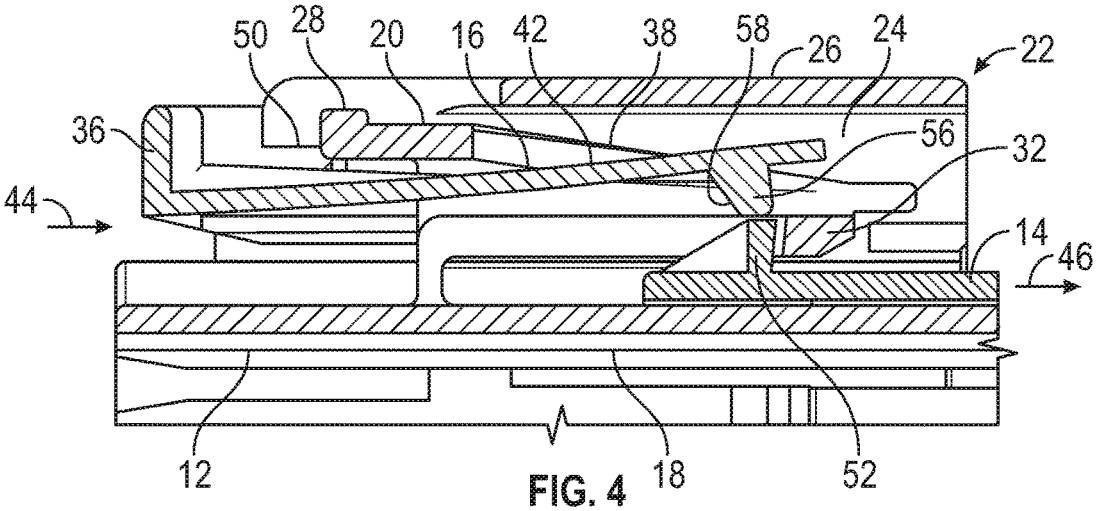
FIG. 4 (Prior Art)
FIG. 4 is a view similar to FIG. 3 showing the connector position assurance moved away from the assurance position relative to a latch on the first connector.

Referring to FIG. 4, a view similar to FIG. 3 is shown, with the prior art CPA 16 moved opposite the assurance direction 44 relative to the first prior art connector 12 to a pre-lock position. The CPA tongue 42 includes a CPA catch 56 that extends from the CPA tongue 42 toward the first connector body 18. When the prior art CPA 16 is moved away from the assurance position, a sloped release surface 58 of the CPA catch 56 engages the latch hook 32 and causes the CPA catch 56 and the CPA tongue 42 to move relative to the CPA base 36, away from the first connector body 18, to a deflected position. When the CPA tongue 42 is deflected, the CPA arms 38 remain engaged with the latch arms 30 while the CPA tongue 42 bends. When the prior art CPA 16 has been moved to the pre-lock position, the CPA tongue 42 remains in the deflected position and is engaged with the catch 52 on the second prior art connector 14.

When the prior art CPA is in the pre-lock position, the lock tabs 48 are no longer located in lock notches 50. As a result, the latch 20 and the prior art CPA 16 are able to move relative to the first connector body 18. When the operator applies the release force 54 to the latch base 28, the resilient arms 30 bend and allow the latch 20 to move to an open position shown in FIG. 5. With the latch 20 in the open position, the latch hook 32 is moved away from the first connector body 18 and is no longer engaged with the catch 52. Thus, the first prior art connector 12 can be moved opposite the mate direction 46 relative to the second prior art connector 14.

Figure 6:
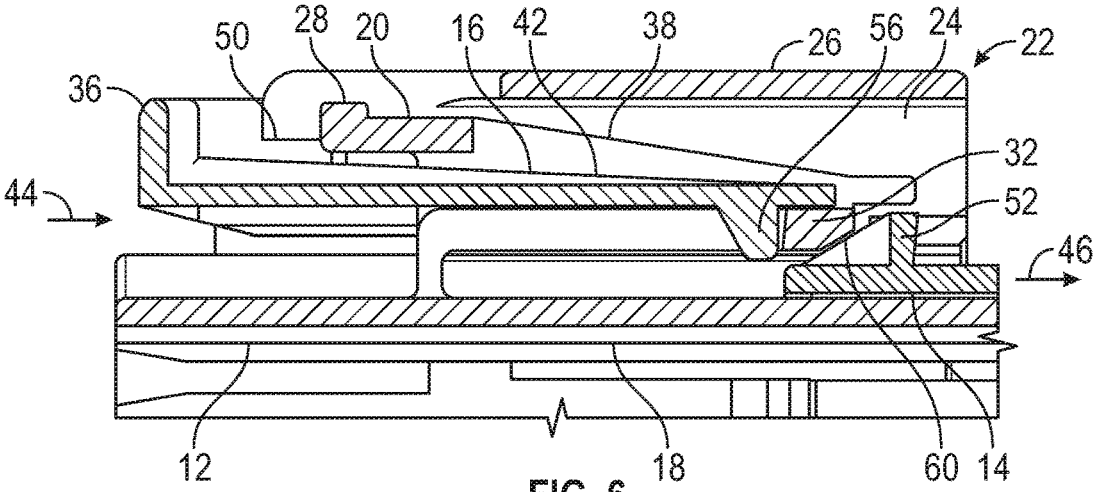
FIG. 6 (Prior Art)
FIG. 6 is a view similar to FIG. 5 showing the connector position assurance and the latch moved to a pre-mate position relative to the second connector.

Referring to FIG. 6, the first prior art connector 12 is shown moved opposite the mate direction 46 relative to the second prior art connector 14 to a pre-mate position. When the operator stops applying the release force 54 to the latch base 28, the latch 20 will rebound to the closed position as shown. However, because the latch hook 32 is not engaged with the catch 52, the first prior art connector 12 may be separated from the second prior art connector 14.

Figure 5:
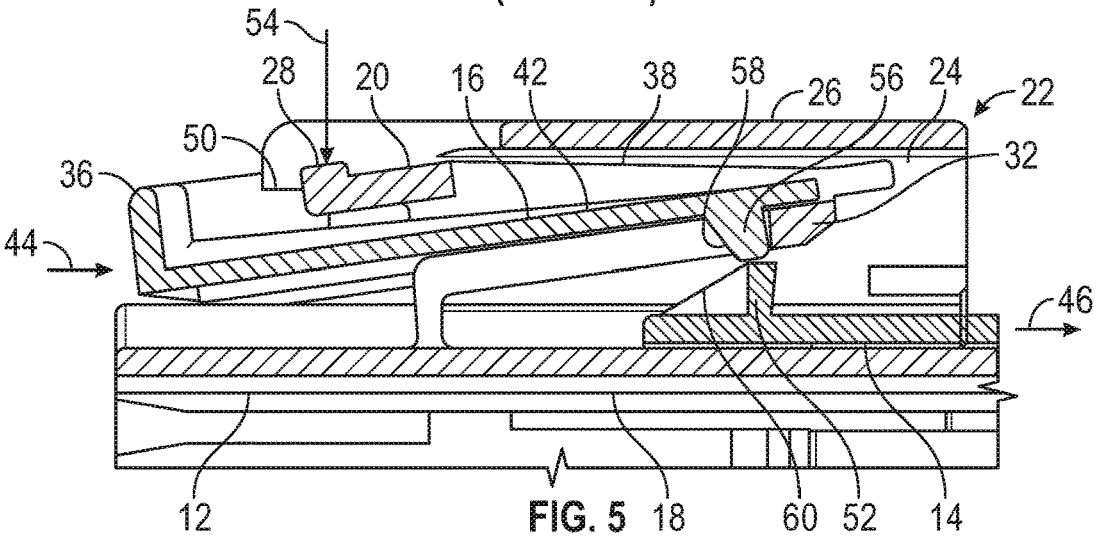
FIG. 5 (Prior Art)
FIG. 5 is a view similar to FIG. 4 showing the latch moved to an open position.

In order to move the first prior art connector 12 to the mated position relative to the second prior art connector 14, the previously described process is reversed. The first prior art connector 12 is placed in the pre-mate position relative to the second prior art connector 14, as shown in FIG. 6. The first prior art connector 12 is moved in the mate direction 46 relative to the second prior art connector 14. The catch 52 includes a sloped hook guide 60 that engages the latch hook 32 and causes the latch 20 to bend at the resilient arms 30 so that the latch 20 deflects to the open position, as shown in FIG. 5. When the latch hook 32 has moved in the mate direction 46 past the catch 52, the latch will rebound to the closed position, as shown in FIG. 4. At this point, the first prior art connector 12 is mated with the second prior art connector 14. The operator then pushes the prior art CPA 16 in the assurance direction 44 direction relative to the first prior art connector 12 to the assurance position, as shown in FIG. 3. At this point the lock tabs 48 are located in the lock notches 50, which prevents the latch 20 from moving relative to the first connector body 18. The electrical connector assembly 10 is now in the mated position, as shown in FIGS. 2 and 3.

Figure 7:
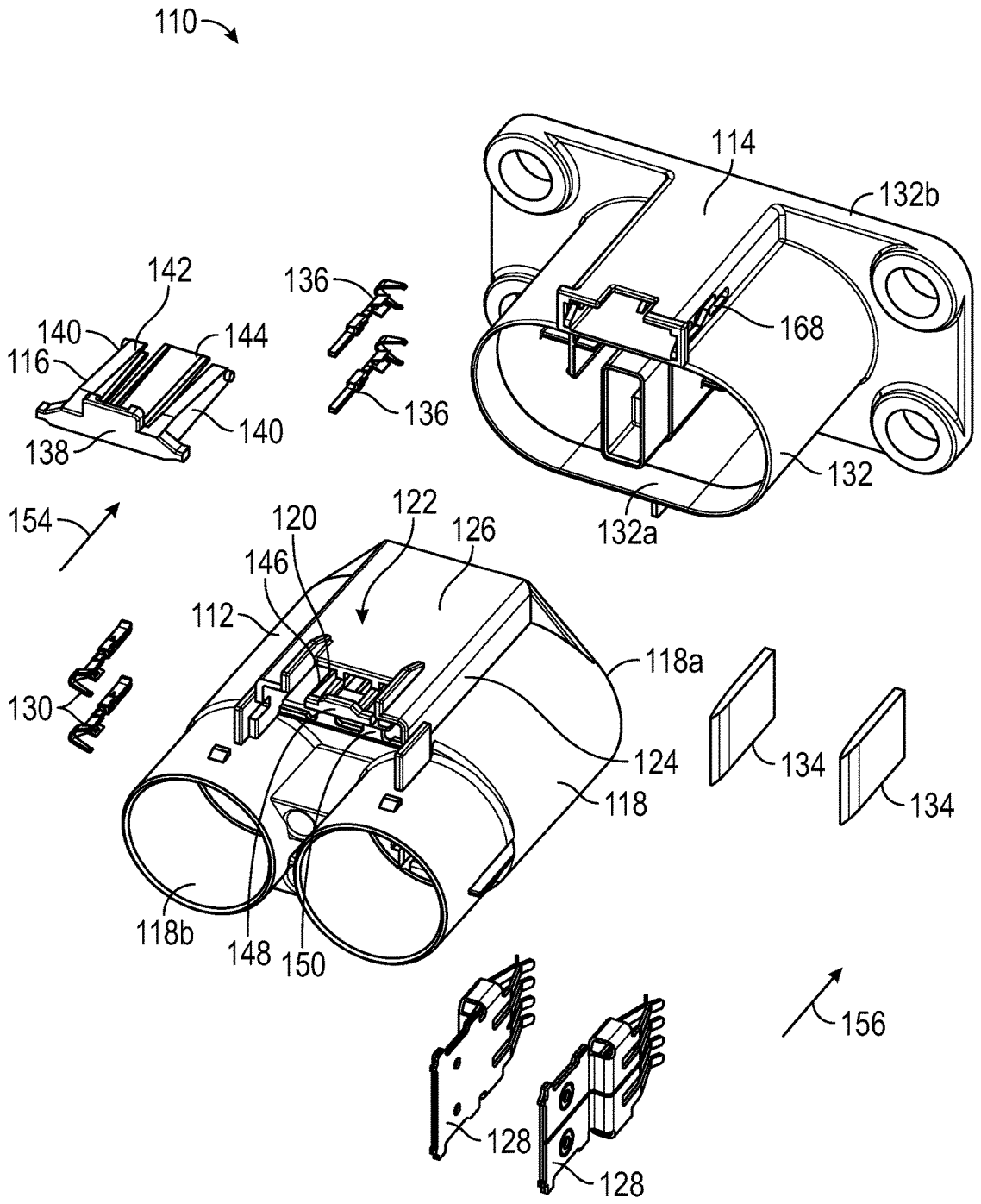
FIG. 7 is an exploded perspective view of an electrical connector assembly in accordance with the invention including a first connector, a second connector, and a connector position assurance.

Referring now to FIG. 7, there is shown an exploded perspective view of an electrical connector assembly, indicated generally at 110, in accordance with one embodiment of the invention. The electrical connector assembly 110 includes a first connector 112, a second connector 114, and a CPA 116. The illustrated first connector 112 is made of plastic, but may be made of any desired material. The first connector 112 includes a first connector body 118 that extends from a mate end 118*a* to an insertion end 118*b*. The first connector 112 also includes a latch 120 that is attached to the first connector body 118. The illustrated latch 120 is integrally molded with the first connector body 118, but may be a separate piece if desired. The first connector 112 further includes a latch cover, indicated generally at 122. The latch cover 122 includes two side walls 124 that extend from the first connector body 118 and an upper cover 126 that extends between the side walls 124. The latch 120 is generally located between the first connector body 118 and the latch cover 122 in order to protect the latch 120 from accidental contact.

The first connector 112 is configured to hold a plurality of electrical terminals, including first primary electrical terminals 128 and first secondary electrical terminals 130. In the illustrated embodiment, the first connector 112 holds two first primary electrical terminals 128 and two first secondary electrical terminals 130, but it may hold any desired number or combination of electrical terminals 128 and 130. In the illustrated embodiment, the electrical terminals 128 and 130 are female electrical terminals, but they may be any desired type of electrical terminal. The illustrated first primary electrical terminals 128 are configured to be connected to primary wires (not shown) as part of a high voltage circuit, and the illustrated first secondary electrical terminals 130 are configured to be connected to secondary wires (not shown) as part of a high voltage interlock loop (HVIL).

The illustrated second connector 114 is made of plastic, but may be made of any desired material. The second connector 114 includes a second connector body 132 that extends from a mate end 132*a* to an insertion end 132*b*. The illustrated second connector 114 is a header, but may be any desired type of electrical connector.

The second connector 114 is configured to hold a plurality of electrical terminals, including second primary electrical terminals 134 and second secondary electrical terminals 136. In the illustrated embodiment, the second connector 114 holds two second primary electrical terminals 134 and two second secondary electrical terminals 136, but it may hold any desired number or combination of electrical terminals 134 and 136. In the illustrated embodiment, the electrical terminals 134 and 136 are male electrical terminals, but they may be any desired type of electrical terminal. The illustrated second primary electrical terminals 134 are configured to be connected to an electrical device (not shown) as part of the high voltage circuit and the illustrated second secondary electrical terminals 136 are configured to be connected to secondary wires (not shown) as part of the HVIL.

Figure 8:
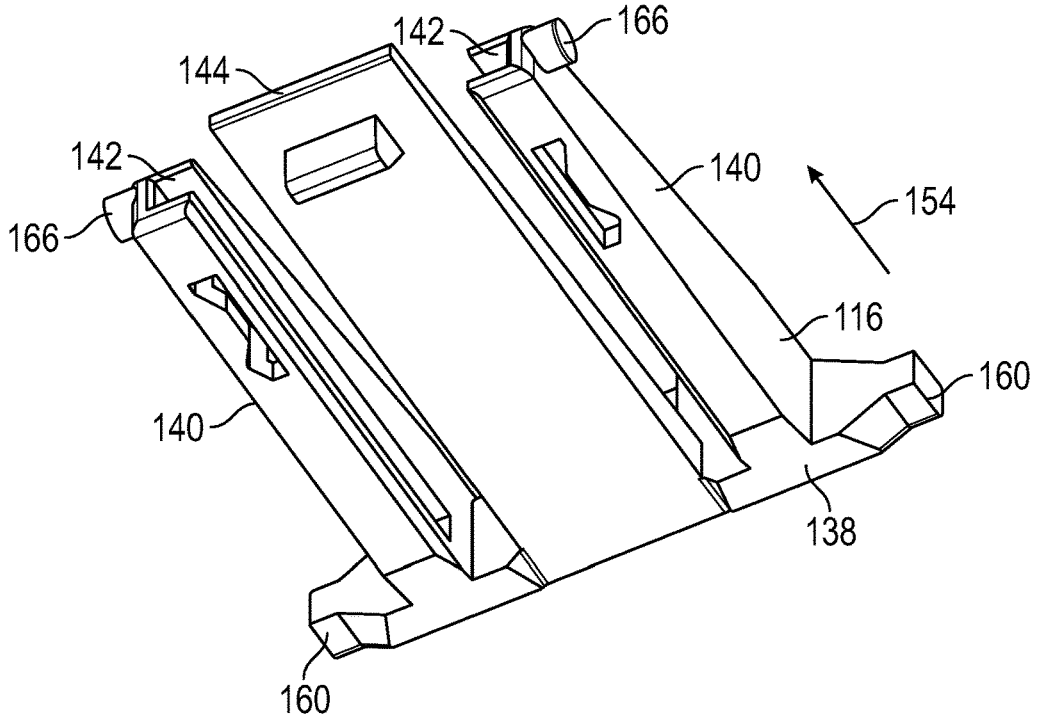
FIG. 8 is an enlarged perspective view from below of the connector position assurance illustrated in FIG. 7.

The illustrated CPA 116 is made of plastic, but may be made of any desired material. An enlarged, perspective view of the CPA 116, taken from below, is shown in FIG. 8. The CPA 116 includes a CPA base 138 and two parallel CPA arms 140 that extend from the CPA base 138. Each CPA arm 140 includes a guide channel 142 on an inner edge thereof. The CPA 116 includes a CPA tongue 144 that extends from the CPA base 138 generally parallel to the CPA arms 140 and between the CPA arms 140. The CPA tongue 144 is resilient and is able to bend relative to the CPA base 138.

In the illustrated embodiment, the CPA 116 is attached to the first connector 112 similarly to the way the prior art CPA 16 is attached to the first prior art connector 12. However, the electrical connector assembly 110 may include any desired type of connector position assurance. The illustrated CPA 116 is attached to the first connector 112 by positioning guide projections 146 on the latch 120 in the guide channels 142 on the CPA 116. The CPA base 138 is positioned so that the CPA tongue 144 is located between a latch base 148 and the first connector body 118 and extends between resilient legs 150 that connect the latch base 148 to the first connector body 118. Additionally, a latch hook 152 is located between the CPA tongue 144 and the first connector body 118. When the illustrated CPA 116 is installed on the first connector 112, it is attached to the latch 120 and is able to be moved in an assurance direction 154 relative to the latch 120, as will be described below.

Figure 9:
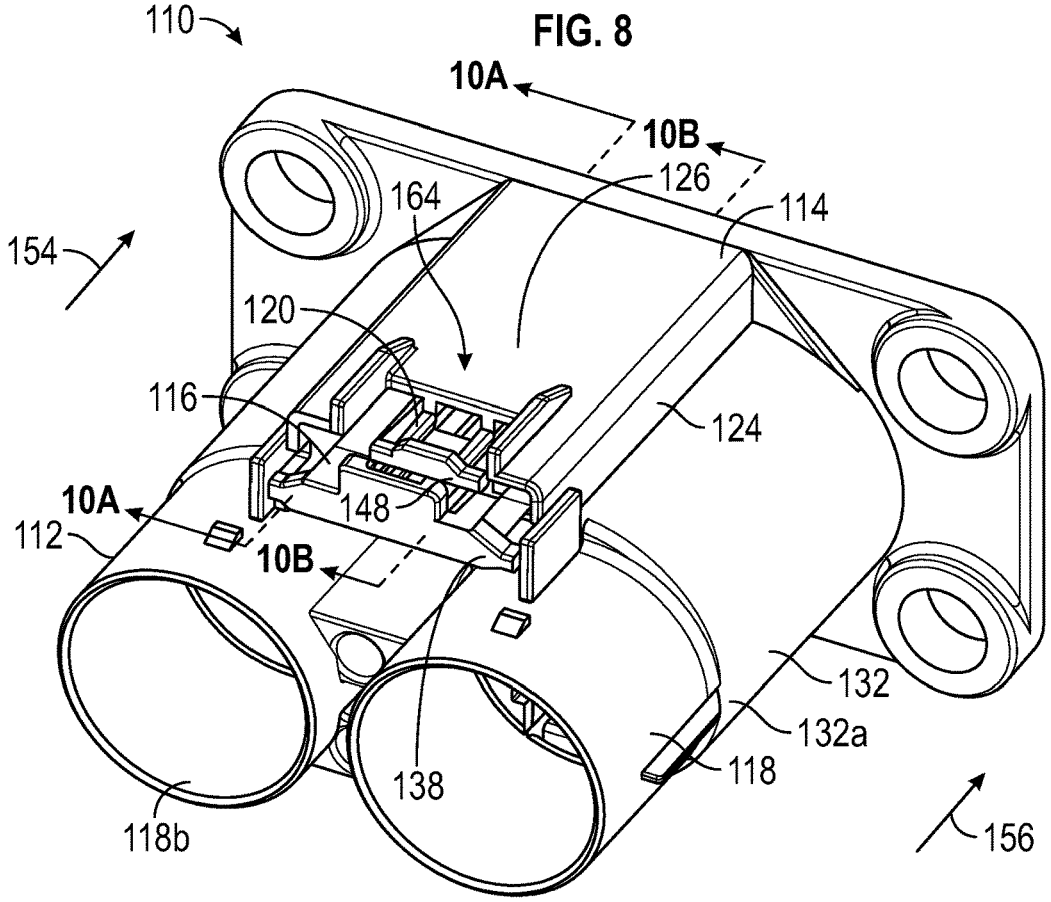
FIG. 9 is an enlarged perspective view of the electrical connector assembly illustrated in FIG. 7 shown assembled.

Referring to FIG. 9, a perspective view of the electrical connector assembly 110 is illustrated in a mated position. As shown therein, the first electrical terminals 128 and 130 are contained in the first connector 112, and the second electrical terminals 134 and 136 are contained in the second connector 114. The first connector 112 has been positioned adjacent to the second connector 114 and moved in a mate direction 156 relative to the second connector 114 so that the first connector 112 and the second connector 114 are in the mated position. The first primary electrical terminals 128 are mated with the second primary electrical terminals 134, and the first secondary electrical terminals 130 are mated with the second secondary electrical terminals 136.

The CPA 116 is shown in a pre-lock position relative to the first connector body 118 in FIG. 9. In this position, the latch 120 is able to move relative to the first connector body 118. Thus, the operator may apply a release force 158 to unlock the latch 120 in order to unmate the first connector 112 from the second connector 114, similarly to the previously-described prior art electrical connector 10. The CPA 116 may be moved in the assurance direction 154 relative to the first connector 112 to an assurance position, wherein lock tabs 160 on the CPA 116 are located in lock notches 162 on the first connector 112 in order to prevent movement of the latch 120 relative to the first connector body 118. In the illustrated embodiment, the assurance direction 154 is parallel to the mate direction 156. However, the directions 154 and 156 may have any desired relative orientation.

The electrical connector assembly 110 also includes a release switch, indicated generally at 164. The release switch 164 is adapted so that the electrical connector assembly 110 has a staged release such that the first connector 112 separates from the second connector 114 in a plurality of steps, rather than in a single motion. In the illustrated embodiment, the release switch 164 is the latch 120. However, the release switch 164 may be some other component on the electrical connector assembly 110 if desired. As will be described in greater detail below, when the first connector 112 and the second connector 114 are being unmated, the first connector 112 may be moved opposite the mate direction 156 a first distance, and then is prevented from moving farther until the release switch 164 is moved. When the release switch 164 is moved, the first connector 112 may be moved opposite the mate direction 156 an additional distance and is then prevented from moving farther until the release switch 164 is moved again.

This staged release is advantageous because it introduces a time delay into the unmating of the electrical connector assembly 110, which increases the time between the separation of the secondary electrical terminals 130 and 136 and the subsequent separation of the primary electrical terminals 128 and 134. As previously described, the illustrated secondary electrical terminals 130 and 136 are part of the HVIL. Thus, when the electrical connector assembly 110 is unmated, the HVIL will be opened and voltage will be removed from the high voltage circuit and given time to bleed off before the primary electrical terminals 128 and 134 are separated and the high voltage circuit is opened.

Referring back to FIGS. 7 and 8, the CPA 116 includes stop tabs 166. The illustrated CPA 116 includes two stop tabs 166, with one extending from each of the CPA arms 140. However, the electrical connector assembly 110 may have any desired number of stop tabs 166 in any desired location. As shown in FIG. 7, the second connector 114 includes channels 168. The illustrated second connector 114 includes two channels 168, but may include any desired number of channels 168. When the first connector 112 is mated with the second connector 114, one of the illustrated stop tabs 166 will be positioned in each of the channels 168, as will be described below.

FIGS. 10A and 10B through 17A and 17B are pairs of cross sectional views that illustrate portions of the electrical connector assembly 110 taken along the lines A-A and B-B of FIG. 9. Each of the pairs of figures shows the electrical connector assembly 110 in a different stage of mating. The figures with the suffix A are taken through one of the stop tabs 166 of the CPA 116 so that the position of the stop tab 166 relative to the channel 168 is visible. The figures with the suffix B are taken through the center of the CPA 116 so that the position of the CPA tongue 144 relative to the latch hook 152 is visible.

Figure 10A:
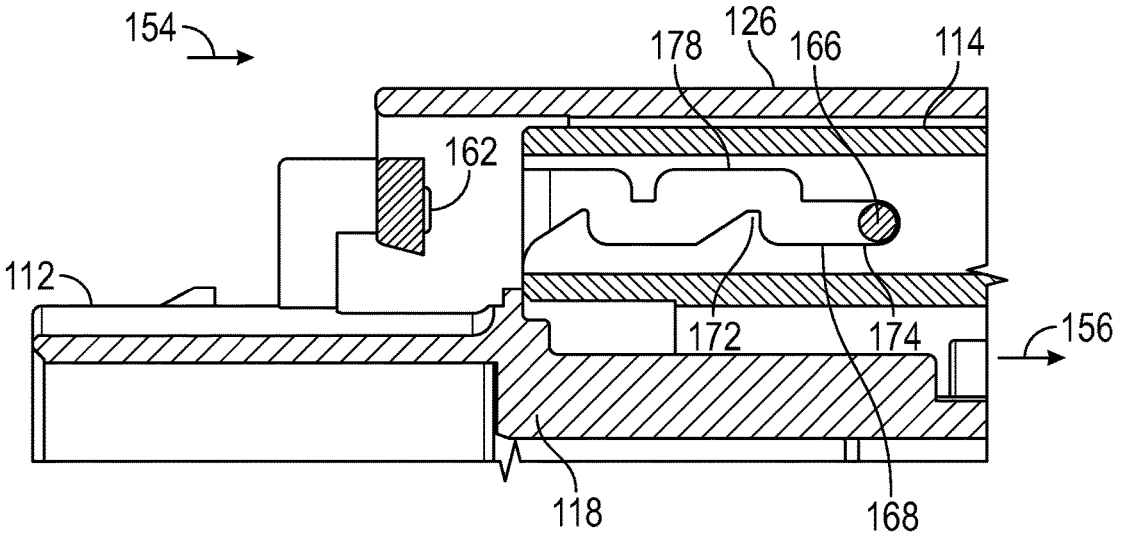
FIG. 10A is a cross sectional view taken along the line A-A of FIG. 9 showing a portion of a channel when the connector position assurance in an assurance position.
Figure 10B:
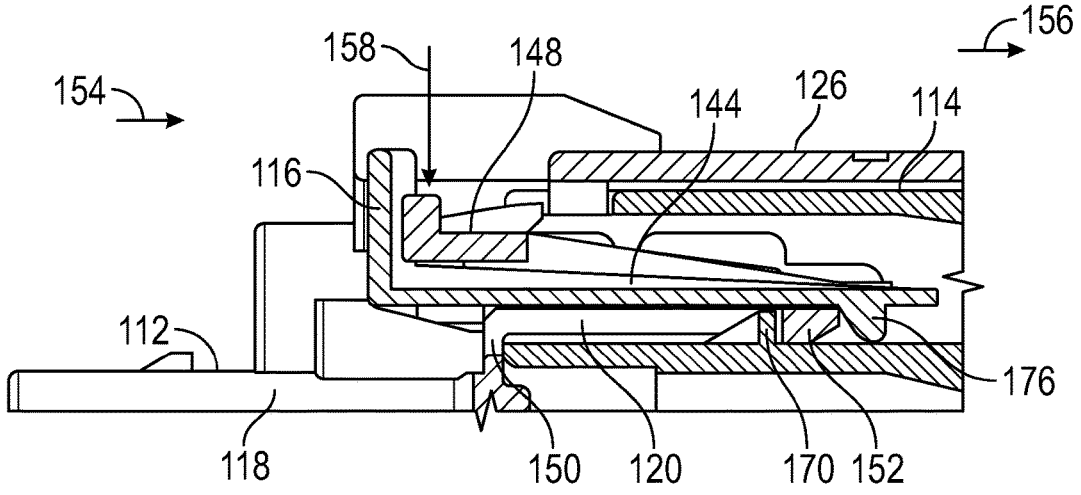
FIG. 10B is a cross sectional view taken along the line B-B of FIG. 9 showing a portion of a lock when the connector position assurance in the assurance position.

As illustrated in FIGS. 10A and 10B, the CPA 116 is in the assurance position relative to the first connector 112, the lock tabs 160 are located in lock notches 162, and the stop tab 166 is located in the channel 168. The CPA 116 prevents the latch 120 from moving relative to the first connector body 118. The latch hook 152 is engaged with a catch 170 on the second connector 114, which prevents the first connector 112 from moving opposite the mate direction 156 relative to the second connector 114.

In the initial condition illustrated in FIGS. 10A and 10B, the first primary electrical terminals 128 are mated with the second primary electrical terminals 134, and the first secondary electrical terminals 130 are mated with the second secondary electrical terminals 136. Thus, in this initial condition, the high voltage circuit is closed, and the HVIL is also closed.

Figure 11A:
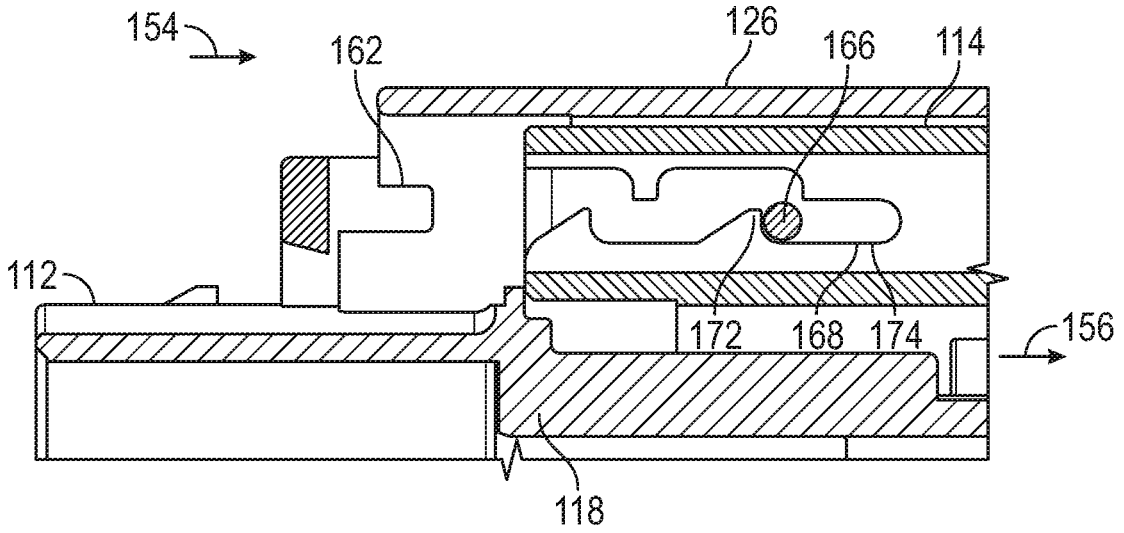
Figure 11B:
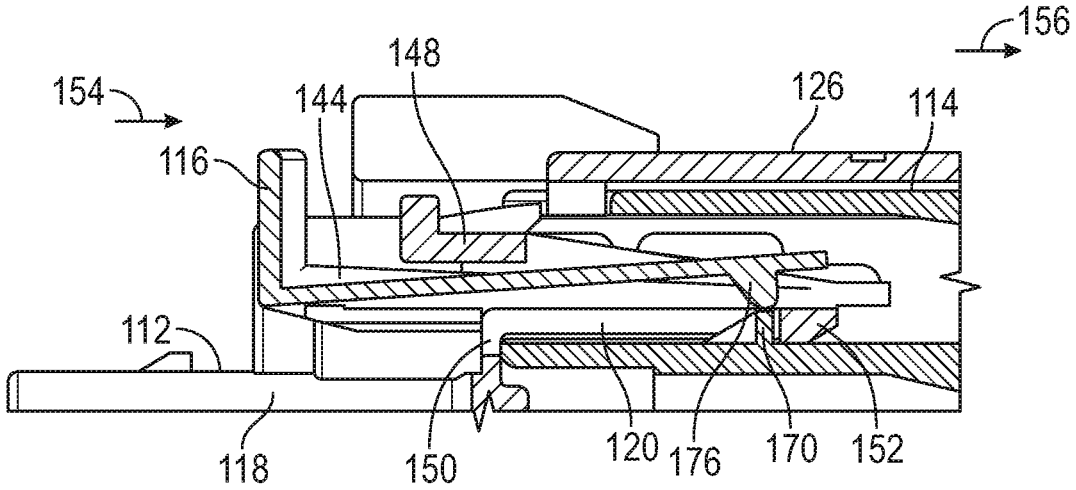

Referring to FIGS. 11A and 11B, the CPA 116 is shown moved from the assurance position opposite the assurance direction 154 to a pre-lock position. When the CPA 116 is in the pre-lock position, the CPA 116 does not prevent an operator from moving the latch 120 relative to the first connector body 118. Also, the lock tabs 160 are no longer located in the lock notches 162, and the stop tab 166 has engaged a first block 172 located in the channel 168 on a first side 174 of the channel 168. In the illustrated embodiment, the first side 174 is the side of the channel 168 that is nearest the first connector body 118. The first block 172 prevents the CPA 116 from moving farther opposite the assurance direction 154 relative to the second connector 114. As seen in FIG. 11B, a CPA catch 176 on the CPA tongue 144 is engaged with the catch 170 and the CPA tongue 144 is moved relative to the CPA base 138 to a deflected position.

Figure 12A:
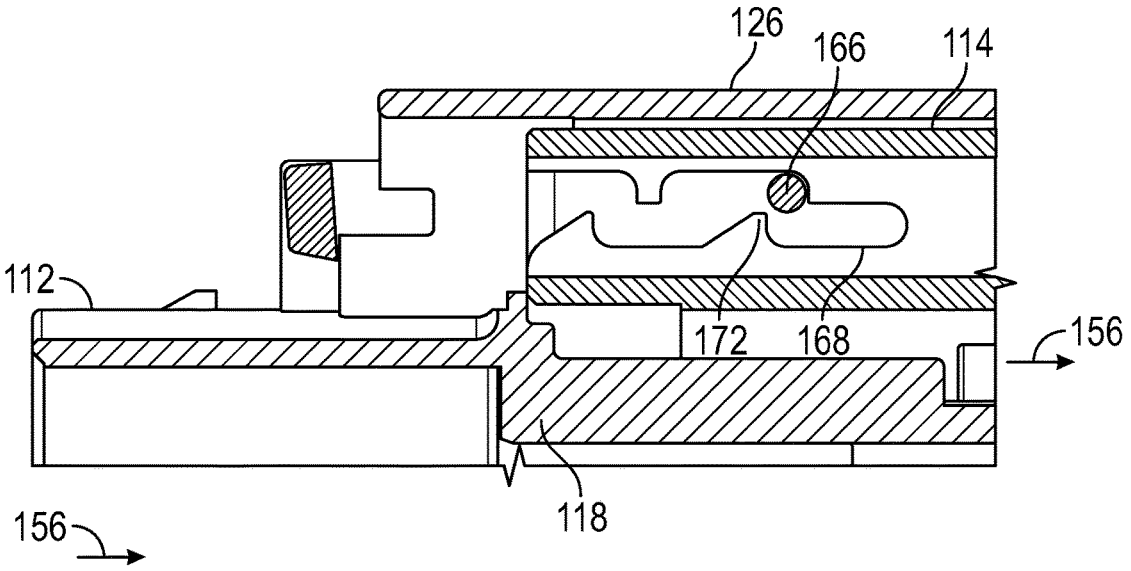
Figure 12B:
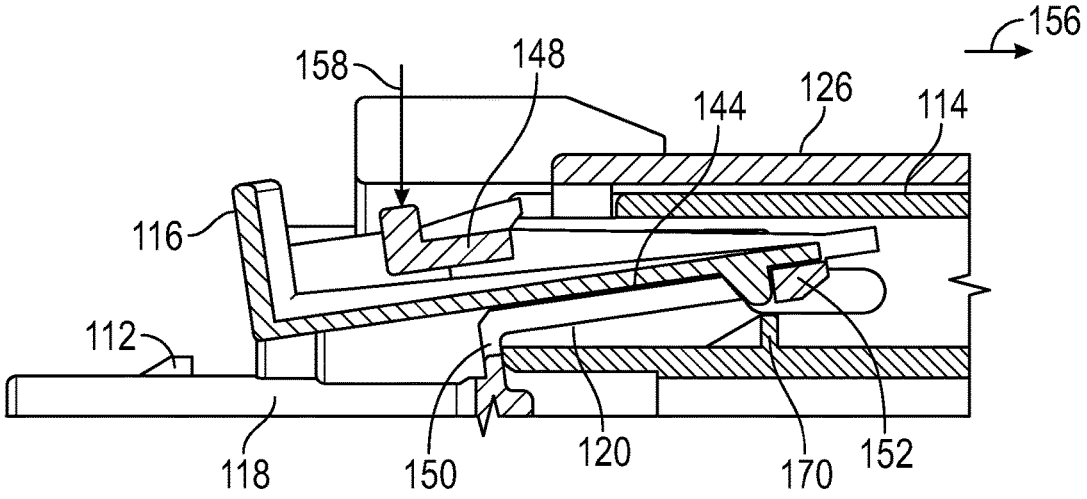

Referring to FIGS. 12A and 12B, a release force 158 has been applied to the latch 120, which causes the latch 120 to bend at the resilient legs 150 so that the latch 120 deflects to an open position. With the latch 120 in the open position, the latch hook 152 is not engaged with a catch 170 on the second connector 114. When the latch 120 is moved, the CPA 116 is also moved so that the stop tab 166 is moved to a second side 178 of the channel 168. The stop tab 166 is then clear of the first block 172. In the illustrated embodiment, the second side 178 is the side of the channel 168 that is farther from the first connector body 118. Thus, in the state shown in FIGS. 12A and 12B, neither the latch 120 nor the stop tab 166 will prevent the first connector 112 from moving opposite the mate direction 156 relative to the second connector 114. By switching the state of the release switch 164, the first connector 112 may be moved opposite the mate direction 156 relative to the second connector 114.

In the state illustrated in FIGS. 12A and 12B, the first primary electrical terminals 128 are mated with the second primary electrical terminals 134, and the first secondary electrical terminals 130 are mated with the second secondary electrical terminals 136. Thus, the high voltage circuit is closed, and the HVIL is also closed. The latch 120 has been moved to the open position, but the first connector 112 has not been moved away from the second connector 114.

Figure 13A:
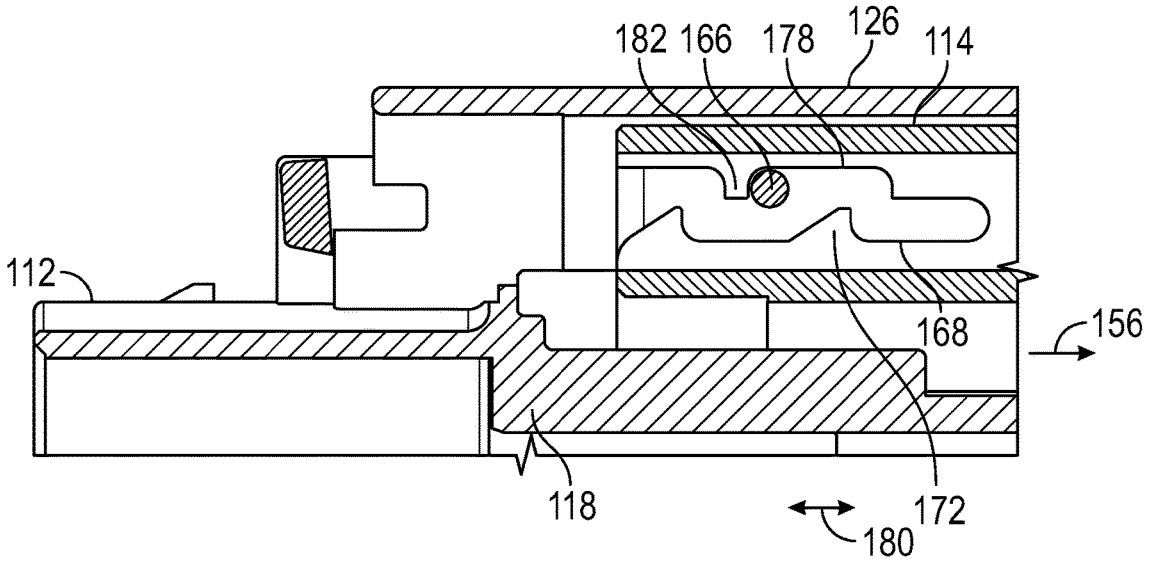
Figure 13B:
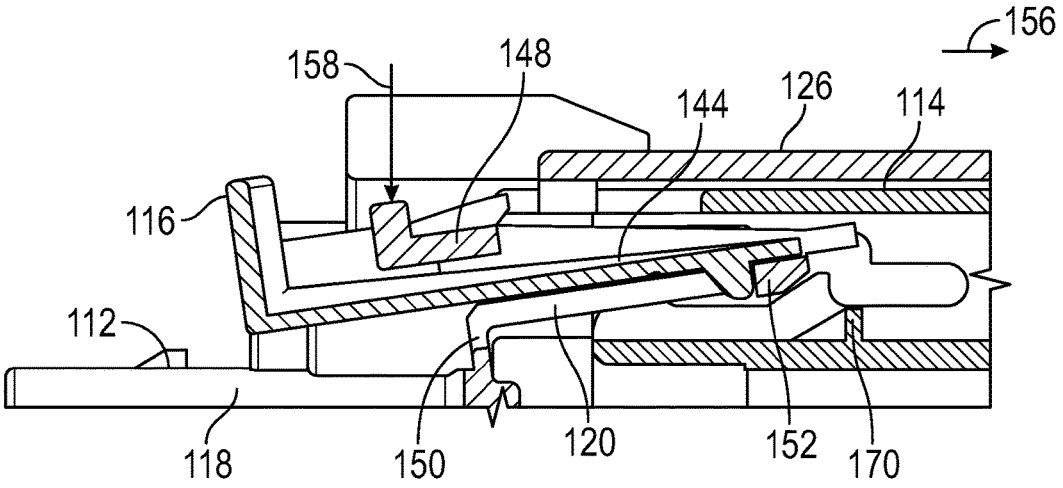

Referring to FIGS. 13A and 13B, the first connector 112 has been moved relative to the second connector 114 a first distance 180 opposite the mate direction 156. Between the state illustrated in FIG. 12B and the state illustrated in FIG. 13B, the CPA 116 has not moved relative to the latch 120, and the CPA 116 and the latch 120 have not moved relative to the first connector body 118. As illustrated in FIGS. 13A and 13B, the latch 120 has remained in the open position, and the stop tab 166 has remained on the second side 178 of the channel 168. The stop tab 166 has engaged a second block 182 on the second side 178 of the channel 168. The second block 182 prevents the CPA 116 from moving farther opposite the mate direction 156 relative to the second connector 114. Because the CPA 116 is attached to the first connector 112, the second block 182 also prevents the first connector 112 from moving farther opposite the mate direction 156 relative to the second connector 114.

In the state illustrated in FIGS. 13A and 13B, the first primary electrical terminals 128 are mated with the second primary electrical terminals 134, while the first secondary electrical terminals 130 are separated from the second secondary electrical terminals 136. Thus, at the illustrated stage of release of the electrical connector assembly 110, the high voltage circuit is closed, while the HVIL is open.

Figure 14A:
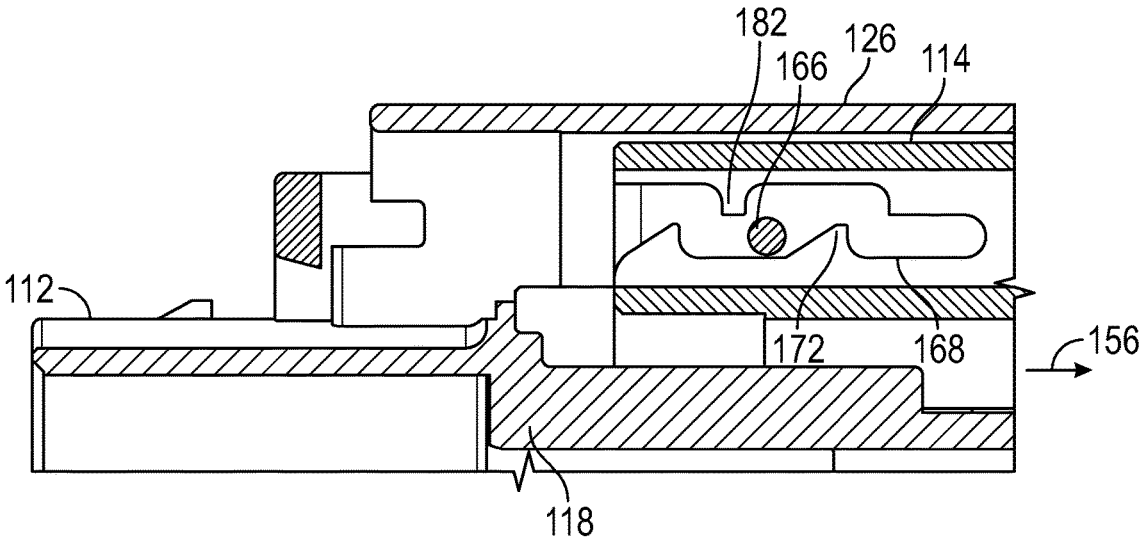
Figure 14B:
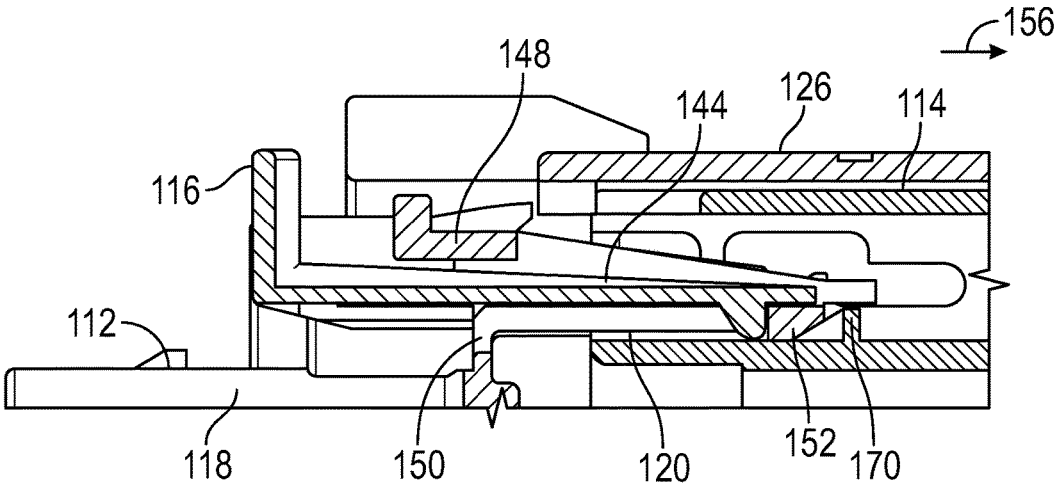

Referring to FIGS. 14A and 14B, the release force 158 is no longer applied to the latch 120, and the latch 120 has rebounded to the closed position. As a result, the stop tab 166 has moved to the first side 174 of the channel 168 and is clear of the second block 182. Because the first connector 112 has moved the first distance 180 relative to the second connector 114, the latch hook 152 does not engage the catch 170 on the second connector 114. Thus, the first connector 112 may be moved opposite the mate direction 156 relative to the second connector 114.

In the state illustrated in FIGS. 14A and 14B, the first primary electrical terminals 128 are mated with the second primary electrical terminals 134, while the first secondary electrical terminals 130 are separated from the second secondary electrical terminals 136. Thus, at the illustrated stage of release of the electrical connector assembly 110, the high voltage circuit is closed, while the HVIL is open.

Figure 15A:
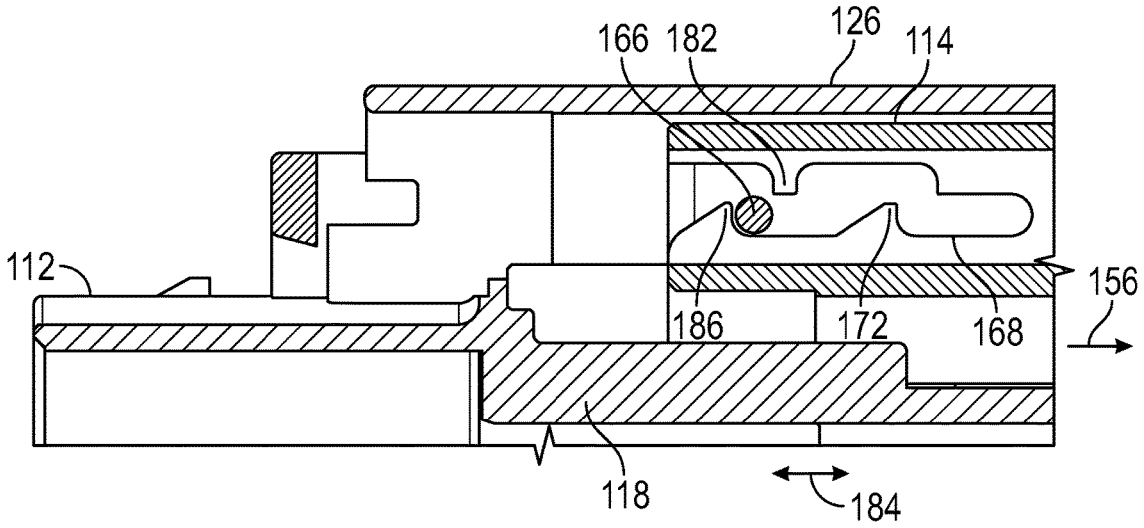
Figure 15B:
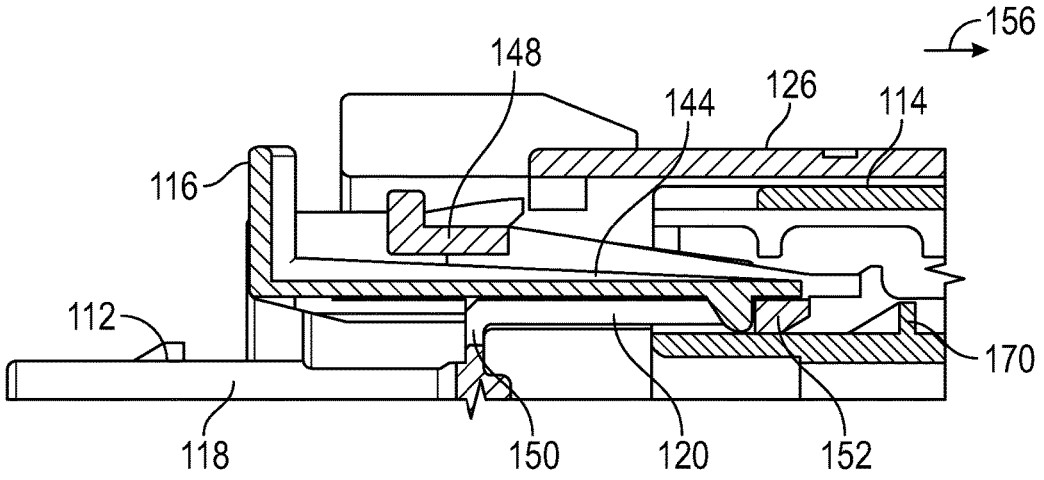

Referring to FIGS. 15A and 15B, the first connector 112 has been moved relative to the second connector 114 a second distance 184 opposite the mate direction 156. The stop tab 166 has engaged a third block 186 on the first side 174 of the channel 168. The third block 186 prevents the CPA 116 from moving farther opposite the mate direction 156 relative to the second connector 114. Because the CPA 116 is attached to the first connector 112, the third block 186 also prevents the first connector 112 from moving farther opposite the mate direction 156 relative to the second connector 114.

In the state illustrated in FIGS. 15A and 15B, the first primary electrical terminals 128 are mated with the second primary electrical terminals 134, while the first secondary electrical terminals 130 are separated from the second secondary electrical terminals 136. Thus, at the illustrated stage of release of the electrical connector assembly 10, the high voltage circuit is closed, while the HVIL is open.

Figure 16A:
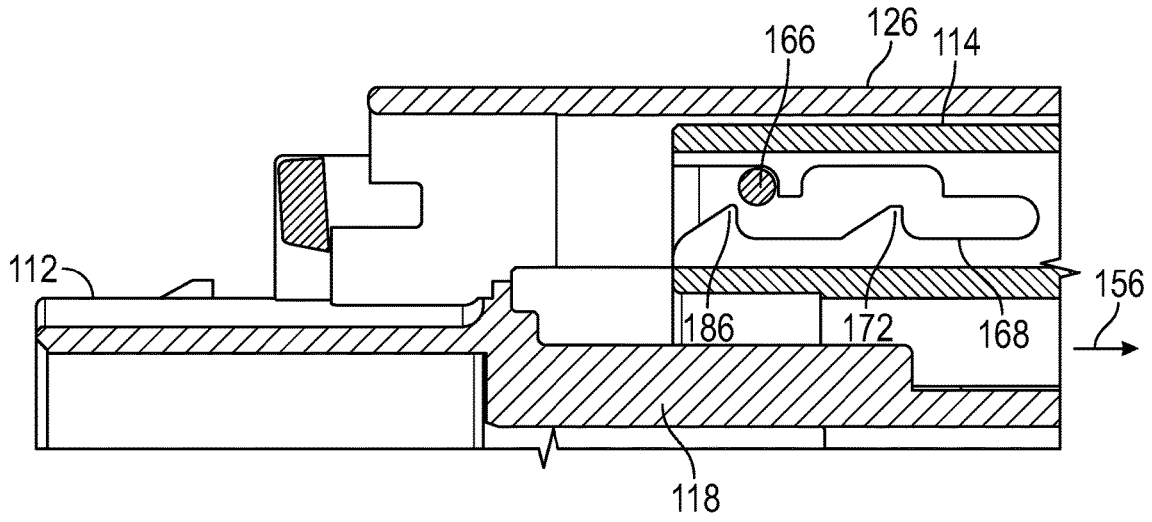
Figure 16B:
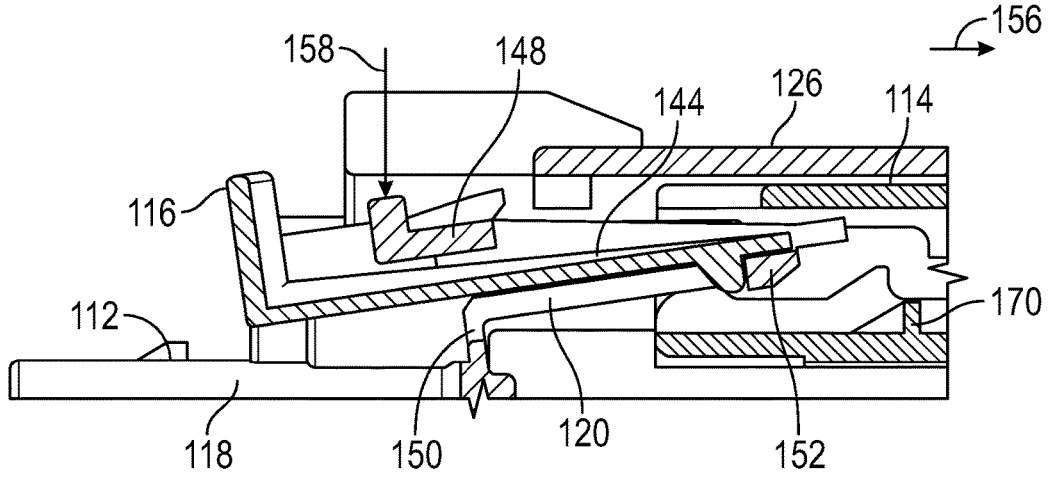

Referring to FIGS. 16A and 16B, the release force 158 has been applied to the latch 120, and the latch 120 is in the open position. The stop tab 166 is moved to the second side 178 of the channel 168 and is clear of the third block 186. By switching the state of the release switch 164, the first connector 112 may be moved opposite the mate direction 156 relative to the second connector 114.

In the state illustrated in FIGS. 16A and 16B, the first primary electrical terminals 128 are mated with the second primary electrical terminals 134, while the first secondary electrical terminals 130 are separated from the second secondary electrical terminals 136. Thus, at the illustrated stage of release of the electrical connector assembly 10, the high voltage circuit is closed, while the HVIL is open.

Figure 17A:
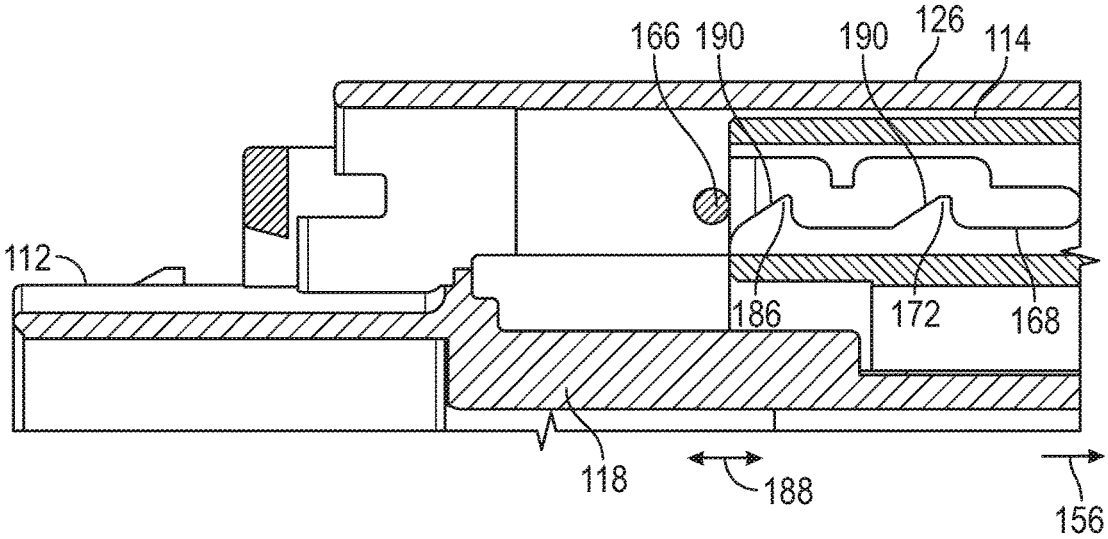
Figure 17B:
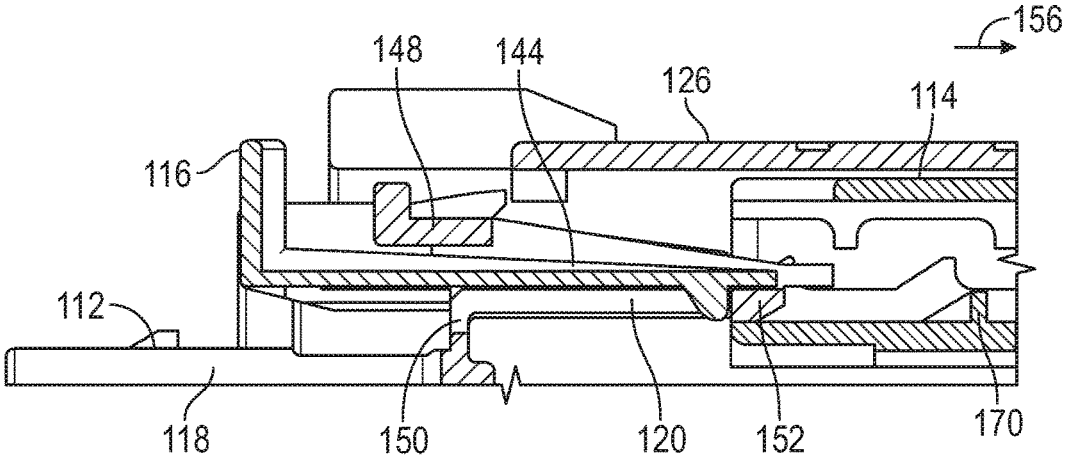

Referring to FIGS. 17A and 17B, the first connector 112 has been moved relative to the second connector 114 a third distance 188 opposite the mate direction 156. Additionally, the latch 120 has rebounded to the closed position. The stop tab 166 is not in the channel 168. The first connector 112 is illustrated in a pre-mate position relative to the second connector 114.

In the state illustrated in FIGS. 17A and 17B, the first primary electrical terminals 128 are separated from the second primary electrical terminals 134, and the first secondary electrical terminals 130 are separated from the second secondary electrical terminals 136. Thus, at the illustrated pre-mate stage of the electrical connector assembly 110, the high voltage circuit is open, and the HVIL is open.

Thus, in order to unmate the electrical connector assembly 110 from the mated position (shown in FIGS. 10A and 10B), the CPA 116 is first moved opposite the assurance direction 154 to the pre-lock position (shown in FIGS. 11A and 11B). The release switch 164 is moved to the open position (shown in FIGS. 12A and 12B), and the first connector 112 is moved relative to the second connector 114 opposite the mate direction 156. After moving the first distance 180, the first connector 112 is stopped from moving farther (shown in FIGS. 13A and 13B). At this point, the HVIL is open. Then, the release switch 164 is moved to the closed position (shown in FIGS. 14A and 14B), and the first connector 112 is moved relative to the second connector 114 opposite the mate direction 156. After moving the second distance 184, the first connector 112 is again stopped from moving farther (shown in FIGS. 15A and 15B). The release switch 164 is moved to the open position (shown in FIGS. 16A and 16B), and the first connector 112 is moved relative to the second connector 114 opposite the mate direction 156 to the pre-mate position (shown in FIGS. 17A and 17B). At this point, the high voltage circuit is open.

The first connector 112 is unmated from the second connector 114 by moving it linearly opposite the mate direction 156. However, the stop tab 166 moves in a non-linear path, and the release switch 164 is used to change the position of the stop tab 166 in order to unmate the first connector 112 from the second connector 114.

In order to mate the electrical connector assembly 110, the previously described process is reversed. However, the first block 172 and the third block 186 include sloped insertion guide surfaces 190 on their respective sides opposite the mate direction 156. The insertion guide surfaces 190 allow the stop tab 166 to move past the first block 172 and the third block 186 without the operator having to manually change the position of the release switch 164.

With the first connector 112 in the pre-mate position relative to the second connector 114 (shown in FIGS. 17A and 17B), the first connector 112 is moved in the mate direction 156 relative to the second connector 114. The stop tab 166 will engage the insertion guide surface 190 on the third block 186, which will cause the release switch 164 to move to the open position. When the stop tab 166 is moved past the third block 186, the release switch 164 will rebound to the closed position (shown in FIGS. 15A and 15B). At this point, the high voltage circuit is closed. The first connector 112 continues to be moved in the mate direction 156 relative to the second connector 114, and the stop tab 166 will engage the insertion guide surface 190 on the first block 172. This will cause the release switch 164 to move to the open position. When the stop tab 166 is moved past the first block 172, the release switch 164 will rebound to the closed position (shown in FIGS. 11A and 11B). At this point, the HVIL is also closed. The CPA 116 is then moved in the assurance direction 154 relative to the latch to the assurance position (to the position shown in FIGS. 10A and 10B), which locks the latch 120 in position.

Thus, the electrical connector assembly 110 allows the first connector 112 to be mated with the second connector 114 using a direct, linear, push-in motion. However, the first connector 112 is unmated from the second connector 114 while repeatedly changing the position of the release switch 164.

The illustrated embodiment includes three blocks 172, 182, and 186, but may include any desired number of blocks. Additionally, the illustrated distances 180, 184, and 188 may have any desired relative magnitudes. In the illustrated embodiment, the release switch 164 is moved back and forth between two positions. However, the release switch 164 may have more than two positions if desired.

The principle and mode of operation of this invention have been explained and illustrated in its preferred embodiment. However, it must be understood that this invention may be practiced otherwise than as specifically explained and illustrated without departing from its spirit or scope.

What is claimed is:

1. An electrical connector assembly comprising:

a first connector including a first electrical terminal;

a second connector including a second electrical terminal, the first connector and the second connector being movable from a mated position toward an unmated position, the second connector including a first block, a second block, and a third block; and a connector position assurance that is movable between an assurance position and a pre-lock position, the connector position assurance including a stop tab, wherein:

the first block is positioned to engage the stop tab when the connector position assurance is located in the pre-lock position;

the second block is positioned to engage the stop tab when the first connector is located a first distance from the second connector; and the third block is positioned to engage the stop tab when the first connector is located a second distance from the second connector.

2. The electrical connector assembly of claim 1 further including a latch on the first connector that is movable between a closed position, wherein the latch engages the second connector to retain the first connector and the second connector in the mated position, and an open position, wherein the latch does not engage the second connector to retain the first connector and the second connector in the mated position.

3. The electrical connector assembly of claim 2 wherein movement of the latch to the open position causes movement of the stop tab out of engagement with the first block.

4. The electrical connector assembly of claim 2 wherein movement of the latch to the closed position causes movement of the stop tab out of engagement with the second block.

5. The electrical connector assembly of claim 2 wherein movement of the latch to the open position causes movement of the stop tab out of engagement with the third block.

6. The electrical connector assembly of claim 2 wherein movement of the latch to the open position causes movement of the stop tab out of engagement with the first block, and wherein movement of the latch to the closed position causes movement of the stop tab out of engagement with the second block.

7. The electrical connector assembly of claim 2 wherein movement of the latch to the open position causes movement of the stop tab out of engagement with the first block, movement of the latch to the closed position causes movement of the stop tab out of engagement with the second block, and movement of the latch to the open position causes movement of the stop tab out of engagement with the third block.

8. An electrical connector assembly comprising:

a first connector including a first electrical terminal;

a second connector including a second electrical terminal, the first connector and the second connector being movable from a mated position, wherein the first and second electrical terminals are connected, toward an unmated position, wherein the first and second electrical terminals are not connected, the second connector including a first block, a second block, and a third block; and a connector position assurance that is movable between an assurance position, wherein the first connector and the second connector are locked in the mated position, and a pre-lock position, wherein the first connector and the second connector are not locked in the mated position, the connector position assurance including a stop tab, wherein:

the first block is positioned to engage the stop tab and thereby prevent movement of the first connector relative to the second connector;

the second block is positioned to engage the stop tab when the first connector is located a first distance from the second connector and thereby prevent further movement of the first connector relative to the second connector from the mated position toward the unmated position; and the third block is positioned to engage the stop tab when the first connector is located a second distance from the second connector and thereby prevent further movement of the first connector relative to the second connector from the mated position toward the unmated position.

9. The electrical connector assembly of claim 8 further including a latch on the first connector that is movable between a closed position, wherein the latch engages the second connector to retain the first connector and the second connector in the mated position, and an open position, wherein the latch does not engage the second connector to retain the first connector and the second connector in the mated position.

10. The electrical connector assembly of claim 9 wherein movement of the latch to the open position causes movement of the stop tab out of engagement with the first block.

11. The electrical connector assembly of claim 9 wherein movement of the latch to the closed position causes movement of the stop tab out of engagement with the second block.

12. The electrical connector assembly of claim 9 wherein movement of the latch to the open position causes movement of the stop tab out of engagement with the third block.

13. The electrical connector assembly of claim 9 wherein movement of the latch to the open position causes movement of the stop tab out of engagement with the first block, and wherein movement of the latch to the closed position causes movement of the stop tab out of engagement with the second block.

14. The electrical connector assembly of claim 9 wherein movement of the latch to the open position causes movement of the stop tab out of engagement with the first block, movement of the latch to the closed position causes movement of the stop tab out of engagement with the second block, and movement of the latch to the open position causes movement of the stop tab out of engagement with the third block.

15. An electrical connector assembly comprising:

a first connector including a first primary electrical terminal and a first secondary electrical terminal;

a second connector including a second primary electrical terminal and a second secondary electrical terminal, the first connector and the second connector being movable from a mated position, wherein the first and second primary electrical terminals are connected in a high voltage circuit and the first and second secondary electrical terminals are connected in a high voltage interlock loop, toward an unmated position, wherein the first and second primary electrical terminals are not connected and the first and second secondary electrical terminals are not connected, the second connector including a first block, a second block, and a third block; and a connector position assurance that is movable between an assurance position and a pre-lock position, the connector position assurance including a stop tab, wherein:

the first block is positioned to engage the stop tab when the connector position assurance is located in the pre-lock position, wherein the first and second primary electrical terminals are connected and the first and second secondary electrical terminals are connected;

the second block is positioned to engage the stop tab when the first connector is located a first distance from the second connector, wherein the first and second primary electrical terminals are connected and the first and second secondary electrical terminals are not connected; and the third block is positioned to engage the stop tab when the first connector is located a second distance from the second connector, wherein the first and second primary electrical terminals are connected and the first and second secondary electrical terminals are not connected.

16. The electrical connector assembly of claim 15 wherein when the first connector is located a third distance from the second connector, the first and second primary electrical terminals are not connected and the first and second secondary electrical terminals are not connected.

17. The electrical connector assembly of claim 15 further including a latch on the first connector that is movable between a closed position, wherein the latch engages the second connector to retain the first connector and the second connector in the mated position, and an open position, wherein the latch does not engage the second connector to retain the first connector and the second connector in the mated position.

18. The electrical connector assembly of claim 17 wherein movement of the latch to the open position causes movement of the stop tab out of engagement with the first block.

19. The electrical connector assembly of claim 17 wherein movement of the latch to the closed position causes movement of the stop tab out of engagement with the second block.

20. The electrical connector assembly of claim 17 wherein movement of the latch to the open position causes movement of the stop tab out of engagement with the third block.

* * * * *